United States Patent [19]

Brenner et al.

[11] 3,938,260

[45] Feb. 17, 1976

[54] ADJUSTABLE BAFFLE FOR APPLIANCE

[75] Inventors: Robert A. Brenner, St. Joseph; Victor W. Cuthbert, Sodus, both of Mich.

[73] Assignee: Whirlpool Corporation, Benton Harbor, Mich.

[22] Filed: Dec. 11, 1974

[21] Appl. No.: 531,789

[52] U.S. Cl. ..... 34/108; 34/130; 259/82; 432/118; 416/87

[51] Int. Cl.[2] ..... F26B 9/04

[58] Field of Search ..... 416/87; 259/82; 68/142; 34/130–138, 108; 432/108, 118

[56] References Cited

FOREIGN PATENTS OR APPLICATIONS 1,154,767 9/1963 Germany ..... 34/130

*Primary Examiner*—Kenneth W. Sprague
*Assistant Examiner*—Larry I. Schwartz
*Attorney, Agent, or Firm*—Hill, Gross, Simpson, Van Santen, Steadman, Chiara & Simpson

[57] ABSTRACT

A baffle for an automatic clothes dryer of a rotating drum type is adjustable in height to compensate for differences in load characteristics and to provide optimum tumbling characteristics for different kinds of loads.

11 Claims, 8 Drawing Figures

ADJUSTABLE BAFFLE FOR APPLIANCE

BACKGROUND OF THE INVENTION

1. Field of the Invention

This invention relates to improvements in movable baffle structures of domestic appliances.

2. Description of the Prior Art

Movable vanes are shown in U.S. Pat. No. 3,084,531 as applied to automatic clothes dryers. U.S. Pat. No. 3,402,576 also shows baffles which are adjustable axially along the perimeter of the drum but not radially.

Other prior art automatic clothes dryers employ baffles of fixed height to keep clothes within the drum tumbling and loosely exposed to the flow of warm drying air passing through the drum. Optimally, all parts of every garment should be repeatedly exposed to the drying environment of the drum equally so that all items of clothing will be dried at the same rate and become dry at about the same time. But since drying or tumbling characteristics of a load depend on drum size, the size of the load, its heaviness or lightness, the texture of the clothes, and baffle configuration, in a given dryer a small or light load will have tumbling characteristics different from those of a larger or heavier load. The prior art, however, does not disclose effective means for adjusting baffle height or configuration to compensate for such differences in load characteristics.

SUMMARY OF THE INVENTION

In accordance with this invention, in an automatic clothes dryer there is an adjustable baffle which has a body portion or housing which is affixed to the interior of a rotating drum and extends parallel to the axis of rotation of the drum. In order to vary the height of the baffle, a blade portion with a spring-biased latch or button is selectively slidable within the body portion in a radial direction relative to the drum. The spring-biased latch or button retains the blade portion in either of two positions, extended or retracted. Guide means within the body portion guide the blade in its movement between the two positions. The blade may be pulled to its extended position but not beyond, and may be retracted by pushing the button in and moving the blade into the baffle body or base.

DESCRIPTION OF THE PREFERRED EMBODIMENTS

In a conventional automatic clothes dryer a rotating drum is used to tumble clothes contained therein and a plurality of radially inwardly extending baffles are fixed to the side wall of the dryer drum to aid in the tumbling process. The purpose of this arrangement is to keep the clothes moving (tumbling) and loosely exposed to the flow of warm drying air passing through the drum. When clothes are allowed to "ball" or "tangle" drying efficiency declines. Further, in the optimum case all parts of every garment are repeatedly exposed to the drying environment of the drum equally so that all items of clothing will be dried at an equal rate and become dry at about the same time.

Some of the parameters affecting clothes tumbling characteristics in the drum of a dryer are drum size, drum shape, drum speed, size of the load, nature of load (heavy towels, nylons, permanent press fabrics, etc.), and baffle configuration. In a given dryer a small load will therefore tend to have tumbling characteristics different from a large load. Likewise, a load of light fabrics such as nylon hose or garments will have tumbling characteristics different from a load of heavy towels.

Figure 1:
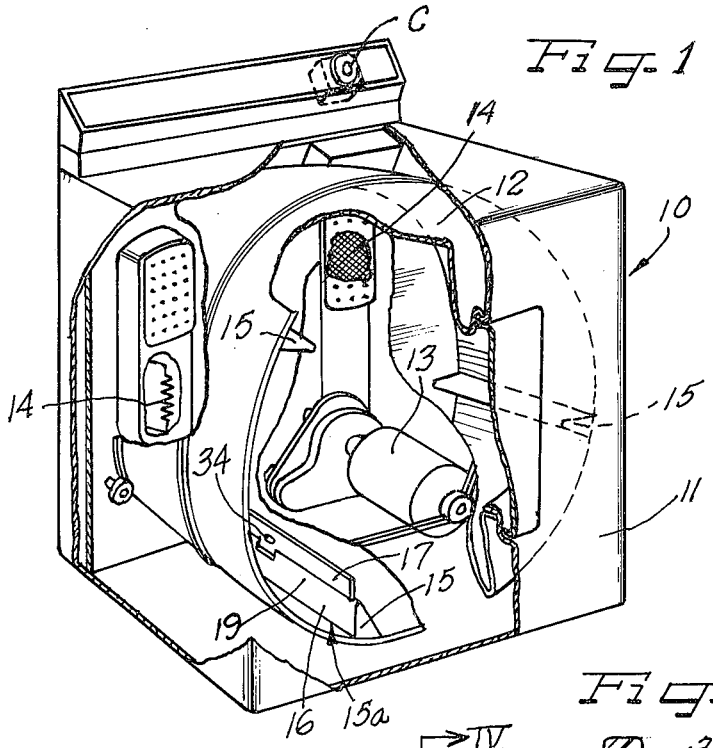
FIG. 1 shows a clothes dryer with its cabinet and drum partially cut away to show the operating elements of the device, including the adjustable baffle of the invention.

Referring to the drawings, a clothes dryer is shown generally at 10 in FIG. 1 and has a cabinet 11 within which rotates a drum 12, driven by a motor 13, and forming a drying zone through which a stream of air is circulated. The stream of air may be temperature conditioned by means of a heating and filtering assembly 14. A controller C is utilized to control and regulate the operation of the dryer through an automatic drying program by pre-selection by an operator.

In accordance with this invention, a plurality of baffles 15 are spaced circumferentially about the interior surface of the drum 12 to assist in controlling the tumbling action of the contents of the drum and to expose surfaces of the clothing to be dryed to the air from the heating and filtering assembly 14.

Figure 2:
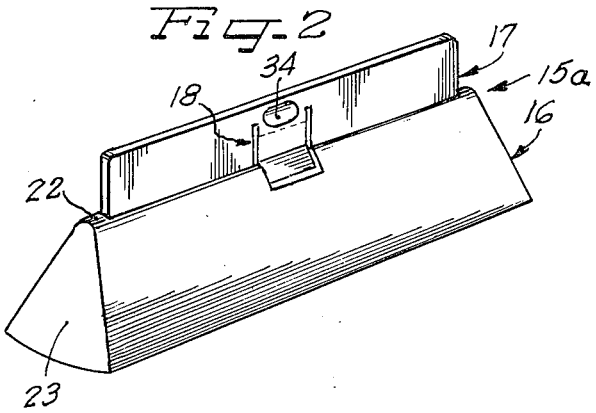
FIG. 2 shows in perspective view the adjustable baffle of this disclosure.

The dryer drum may, for example, include three baffles equally spaced about the circumference of the drum, and in one prototype device, which yielded good results one of these three baffles was of the adjustable type as hereinafter described and as shown in FIG. 2. The baffle 15*a* is adjustable in height so that tumbling conditions in the drum may be selectively optimized. Thus, the baffle 15*a* comprises a fixed body portion 16 and a relatively movable blade portion 17 shown in extended position in FIG. 2. In order to lock the blade in its extended position, detent means 18 are provided which may be manually operable in a latching mode, if desired, or overcome by operator intervention.

Figure 3:
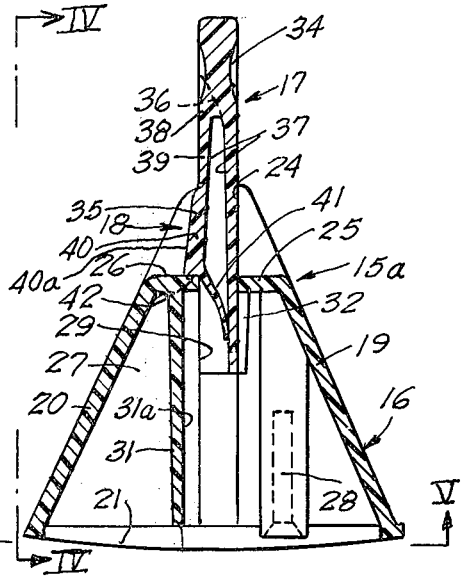
FIG. 3 is a cross-sectional view of the adjustable baffle taken on line III—III of FIG. 4.
Figure 4:
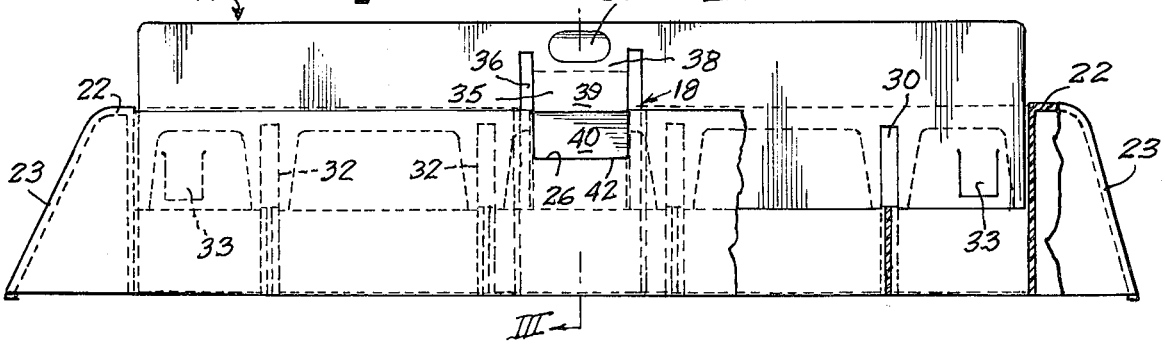
FIG. 4 is an elevational view of the adjustable baffle taken on line IV—IV of FIG. 3 and showing the adjustable blade in its extended position in full lines and showing the blade in its retracted position in dotted lines.
Figure 5:
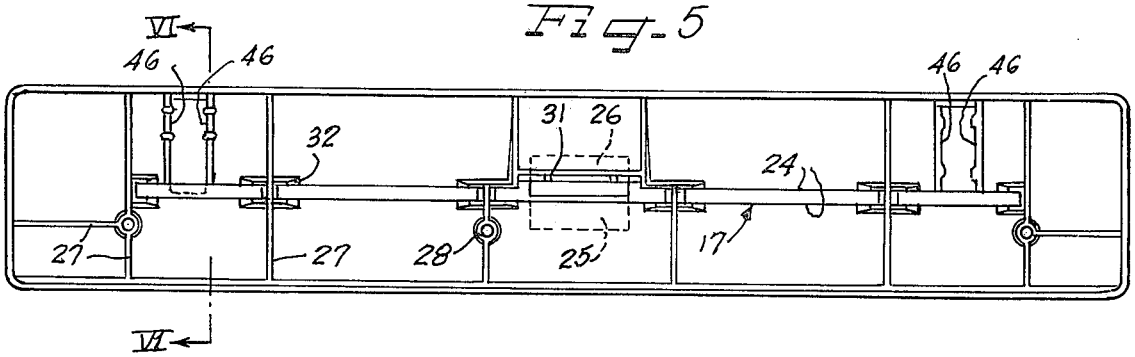
FIG. 5 is a bottom plan view of the adjustable baffle taken on line V—V of FIG. 3.

Details of the structure of the adjustable baffle 15*a* are shown in FIGS. 3 through 5. The body portion 16 has inclined walls 19 and 20 which are joined together at their base by spacing webs 21 which are curved to closely engage the curved interior surface of the dryer drum 12. The walls 19 and 20 of the body portion 16 of the baffle 15*a* meet at shoulders 22, 22 near opposite ends 23, 23 of the baffle 15*a*, and are separated by an elongated aperture or slot 24 disposed between the shoulders 22, 22 of the body 16 and which allows the blade 17 to move in and out vertically within the slot formed thereby. A longitudinally central part of each of the walls 19 and 20 is recessed as at 25 and 26 to form a receptacle for a detent means 18 on the blade 17.

The baffle body 16 may include a number of interior webs 27 which brace the walls 19 and 20. A screw receptacle means 28 may be provided for securing the baffle 15*a* to the interior of the drum 21 by means of appropriate screw fasteners. The webs 27 are slotted as at 29 to pass the upper part of the blade portion 17 while the lower part of the blade portion 17 is cooperatively slotted as at 30 to pass the lower portion of each web 27 upon lowering of the blade.

The recessed portion 26 of the exterior wall 20 is also supported by a longitudinal web 31. About the upper portion of each bracing web 27 is a support and guide web 32 which slidably engages the sides of the blade 17 about each of the slots 30 therein.

The blade portion 17 is conveniently formed in one piece. It principally consists of a flat bar having a length and a thickness to slidably engage the slot 24 in the body 16. The blade 17 has a height as in the configuration of FIGS. 3 or 4, of several inches, sufficient to effect a change in overall baffle height of an inch or more and thereby to substantially affect the tumbling characteristics of garments in the clothes dryer.

As shown in FIGS. 1 through 4, a central portion of the blade 17 provides detent means here shown as a flexible latch 18 which may be intergrally molded therein. Shallow retention clip notches 33 are provided in each end of the blade 17 on the same side as the latch 18. Finally, an elongated depression 34 is provided in each side of the blade 17 above the latch or button assembly 18 having a length and a depth sufficient to assist a user in pulling the blade outward from its retracted position within the body portion 16.

The latch or button assembly 18 in a first embodiment comprises a flap portion 35 which is separated from the blade 17 longitudinally by slots 36 in one face of the blade 17 and from the thickness of the blade 17 by surfaces forming an air space 37. The flap 35 is attached to the blade 17 along the upper edge of the flap along a hinge line at a hinge portion 38. The flap 35 has a spring portion 39 which acts to bias outwardly a portion adapted to be engaged by the finger or thumb digit of an operator, such as a button portion 40 located on the flap, outwardly and away from the air space 37. A lower spring portion 41 further biases the button 40 outwardly when the blade is in its retracted position. In the extended position of the blade shown in FIG. 3, a lower shoulder or abutment ledge 42 of the button 40 extends outwardly from the air space 37 to rest upon the surface 26 of the body portion 16 to obstruct retraction of the blade. In the retracted position, a front surface 40*a* of the button 40 frictionally contacts an adjoining portion 31*a* of longitudinal web 31 to resist extension of the blade 17.

Figure 6:
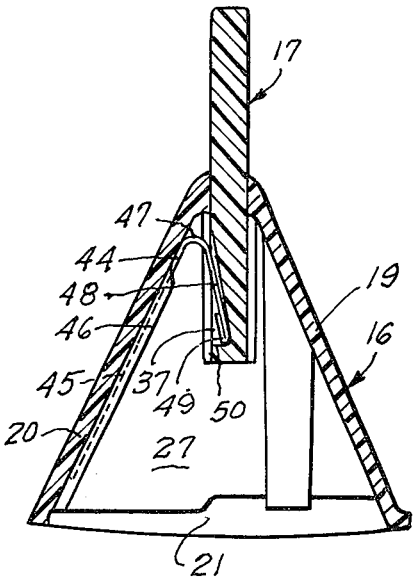
FIG. 6 shows a cross-section of the baffle along line VI—VI in FIG. 5, showing additional details of the spring retention clip.

The spring means or blade retention means is shown in cross section in FIG. 6. A metal spring 44 is formed from flat spring material to have a wall-engaging portion 45 which is captured by retention channels 46 on the inner surface of the wall 20. The spring clip 44 is bent at a springing portion 47 as shown in FIG. 6. Angled downwardly outward from the wall-engaging portion 45 is a blade engaging portion 48 having a rounded end 49. The blade engaging portion 48 engages the retention clip notch 33 on an end portion of the blade 17. As best seen in FIGS. 4 and 5, a spring 44 and the aforementioned cooperating channels 46 and notch 33 are located on opposite end portions of the baffle 15. When the blade is extended, the blade engaging portion 48 slips or snaps into the retention clip notch 33 and the rounded end 49 abuts a shoulder 50 near the lower edge of the blade 17 adjacent the notch 33. In the retracted position, the blade engaging portion 48 of the spring retention clip 44 will rest against the side of the blade 17 in a holding relationship to resist outward movement of the blade with respect to the housing. The retention clip 44 will maintain frictional contact with, but not obstruct the blade 17 during movement between the retracted and extended positions.

Figure 7:
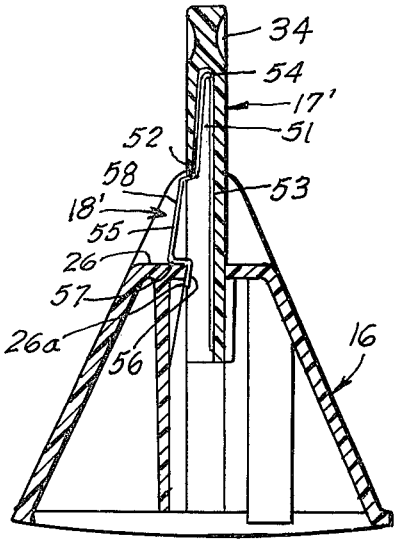
FIG. 7 shows an alternative embodiment of the button means of the present invention.
Figure 8:
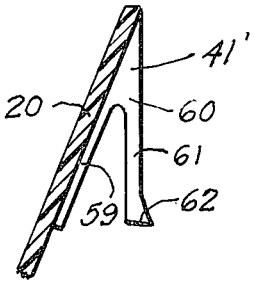
FIG. 8 shows yet another embodiment of the spring retention clip provided in accordance with the invention shown in FIG. 6.

Alternative embodiments of the latch or button assembly and the spring retention clips are shown in FIGS. 7 and 8, respectively.

A spring-metal button assembly 18′ is shown in FIG. 7 and has the same general configuration as the previous embodiment. A blade 17′ is cut away at its central portion, or is molded, to have surfaces defining a downward-facing slot 51 between the front and back walls of the blade 17. The interior of slot 51 opens to the front of the blade 17 at a shoulder 52 in the blade material 17′. The button assembly 18′ has a rear portion 53 which engages and may be bound to the rear wall of the slot and cut in the blade 17′. The button assembly further has a rounded spring portion 54 which fits snugly within the space 51 between the front and rear walls of the blade 17, biasing a button portion 55 outwardly from the rear portion 53. Below the button portion 55 is a flange portion 56. The button 55 has a lower shoulder or abutment portion 57 which in the extended position of the blade 17′ abuts the surface 26 of the body 16, while the flange 56 engages the edge of the wall 26 to prevent the button 55 from springing further outwardly. A front surface 58 of the button 55 frictionally engages a contact surface 26*a* of the fixed body portion 16′ when the blade 17′ is in its retracted position, to resist extension of the blade.

FIG. 8 shows an alternative embodiment of the spring retention clip 44 of FIG. 6. Here a spring retention clip 44′ may be made from a plastic material, with a wall-engaging portion 59, a juncture portion 60, an arm portion 61 and an abutment portion 62. The wall portion 59 may be bonded to the wall 20 of the lower body portion 16, obviating the need for separate channel-type retention means 46 as in the previous embodiment, although channels may be retained to ensure accurate alignment. The abutment portion 62 of the retention clip 44′ engages the shoulder 50 of the blade 17 in its extended position as does the rounded lower portion 49 of the first embodiment 44.

By employing our invention in an otherwise conventional clothes dryer providing one adjustable baffle structure as shown and described herein in conjuction with two conventional fixed baffles, it was found that for loads containing sheets (sheets only, or sheets in addition to other items) a trend for improved drying performance was experienced with the adjustable baffle in its extended position. Furthermore, it was found that clothes loads including large towels experienced generally faster drying with the adjustable baffle extended than with the baffle in its retracted position.

Although various modifications might be suggested by those versed in the art, it should be understood that we wish to embody within the scope of the patent warranted hereon all such modifications as reasonably and properly come within the scope of our contribution to the art.

The embodiments of the invention in which an exclusive property or privilege are claimed are defined as follows:

1. A clothes dryer having a drum rotatable about an axis for tumbling clothes being dried and an adjustable baffle, said adjustable baffle comprising:
   a body portion attached to an interior wall of the drum parallel to said axis;
   a blade portion in said body portion and slidably movable with respect thereto; and
   resiliently biased detent means selectively releasable between said blade portion and said body portion and operative to lock said blade portion in either extended or retracted positions,
whereby tumbling characteristics of clothes within the drum are affected by the position of the blade with respect to the body portion of the baffle.

2. A clothes dryer having a drum rotatable about an axis for tumbling clothes being dried and an adjustable baffle, said adjustable baffle comprising:
   a portion attached to an interior wall of the drum parallel to said axis;
   a blade portion held by said body portion and movable with respect thereto; and
   means for limiting the movement of said blade portion with respect to said body portion between extended and retracted positions,
whereby tumbling characteristics of clothes within the drum are affected by the position of the blade with respect to the body portion of the baffle,
   said body including spring means for engaging said blade to prevent movement of said blade towards the center of said drum beyond said extended position.

3. A clothes dryer as defined in claim 2 wherein the blade includes means for releasably engaging the body to lock said blade in its extended position.

4. A clothes dryer as defined in claim 2, wherein the spring means frictionally engages said blade to restrain movement of said blade between said extended and retracted positions.

5. For use in a clothes dryer, a baffle for accommodating differences in load characteristics comprising:
   a hollow body portion having side and end walls and forming an elongated slot in a top surface thereof;
   a movable blade slidably supported in said slot for in and out movement between a first retracted position and a second extended position relative to said body portion thereby to selectively adjust baffle height;
   and resiliently biased detent means releasably locking said blade in said first retracted position and said second extended position.

6. A baffle as defined in claim 5, wherein
   said hollow body portion further has a recess portion in one of its side walls adjacent said slot;
   said recess portion having an upper abutment surface and a lower frictional contact surface; and
   said detent means comprises a flap integral with said movable blade and flexibly attached to a side thereof along a hinge line, said flap having
   a spring portion biasing said flap outwardly from said side of said blade, and
   a latch portion adjacent said spring portion and opposite said hinge line on said flap and having an abutment ledge, a front surface, and a manually biasable surface, said flap being located on said blade in engagable relation to the recess portion of said hollow body,
   the upper abutment surface releasably engaging the abutment ledge of the latch portion when the blade is in its extended position, and
   the lower frictional contact surface frictionally engaging the latch when the blade is in its retracted position.

7. A baffle as defined in claim 5, wherein
   the blade has top and bottom edges and parallel front and back faces extending perpendicular to said edges and parallel to the slot in the body portion, and includes surfaces defining a recess in the blade, said surfaces comprising:
   a rear wall spaced inwardly from the back face of said blade and extending from a line inwardly of the top edge of said blade to said bottom edge, and
   a front wall spaced between said rear wall and said front face and extending from said line to a shoulder joining said front wall with said front face substantially midway between said top and bottom edges of said blade; and wherein
   said detent means comprises a flat spring device having:
   a rear portion engaging said rear wall of said blade recess,
   a spring portion extending from adjacent said line near the top edge of said blade to adjacent said shoulder and being biased outwardly from said rear wall and said rear portion,
   a manually biasable surface portion below said spring portion, a lower abutment portion curved inwardly from said manually biasable surface and extending substantially parallel to the bottom edge of said blade, and
   a flange portion curved downwardly from said lower abutment portion and terminating therebelow;
   said hollow body portion of said baffle having a recess portion in one of its side walls adjacent said blade front face,
   said recess portion having an upper abutment surface and a contact surface adjacent said upper abutment surface facing said blade,
   said lower abutment portion of said spring device releasably engaging said upper abutment surface of said body portion when the blade is in its extended position, and
   said manually biasable surface portion frictionally engaging said contact surface of said body portion when the blade is in its retracted position.

8. A baffle as defined in claim 5 wherein said blade retention means comprise:
   surfaces forming a notch in said blade, said surfaces defined by:
   a shoulder portion inwardly adjacent a lower edge of said blade and parallel thereto and extending into a face of said blade a substantial distance to an edge, and
   a flat ramp portion extending from said edge upward and gradually outward to intersect said face of said blade at a shallow angle; and
   a spring retention clip comprising:
   a wall-engaging portion affixed to an interior surface of a side wall of said body portion to face said notch in said blade, a springing portion curved from said wall-engaging portion to a downwardly angled blade-engaging portion, said blade-engaging portion having an end biased against said blade by said springing portion, said end of said blade-engaging portion abutting said shoulder when said blade is in its extended position and obstructing upward movement of said blade from said second extended position, and said end frictionally engaging a face of said blade when said blade is in its retracted position.

9. A baffle as defined in claim 5 wherein said blade retention means comprises:

surfaces forming a notch in said blade, said surfaces defined by:

a shoulder portion inwardly adjacent a lower edge of said blade and parallel thereto and extending into a face of said blade a substantial distance to an edge, and a flat ramp portion extending from said edge upward and gradually outward to intersect said face of said blade at a shallow angle; and a spring retention clip comprising:

a wall-engaging portion affixed to an interior surface of a side wall of said body portion facing said notch in said blade, a juncture portion flexibly joining an upper end of said wall-engaging portion to an arm portion, said arm portion carrying at an end opposite the juncture portion an abutment portion and biasing said abutment portion outwardly against said blade and notch, and said abutment portion abuttting said shoulder of said blade notch when said blade is in its extended position and obstructing upward movement of said blade once said abutment occurs.

10. For use in a clothes dryer, a baffle for accommodating differences in load characteristics as defined in claim 5 and further characterized by blade retention means which obstruct movement of said blade outwardly from the body portion beyond the extended position of said blade.

11. For use in a clothes dryer, a baffle for accommodating differences in load characteristics as defined in claim 10 and further characterized by means for resisting blade movement between said first retracted and said second extended positions.

* * * * *

UNITED STATES PATENT AND TRADEMARK OFFICE

CERTIFICATE OF CORRECTION

PATENT NO. : 3,938,260

DATED : February 17, 1976

INVENTOR(S) : Robert A. Brenner and Victor W. Cuthbert

It is certified that error appears in the above-identified patent and that said Letters Patent are hereby corrected as shown below:

Claim 2, column 5, line 21, before "portion" insert --body--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*